US006642677B1

(12) United States Patent
Douglas

(10) Patent No.: US 6,642,677 B1
(45) Date of Patent: Nov. 4, 2003

(54) LINAC FOCUSED BY GRADED GRADIENT

(75) Inventor: David Douglas, Newport News, VA (US)

(73) Assignee: Southeastern Universities Research Assn., Newport News, VA (US)

( * ) Notice: Subject to any disclaimer, the term of this patent is extended or adjusted under 35 U.S.C. 154(b) by 158 days.

(21) Appl. No.: 09/966,469

(22) Filed: Sep. 28, 2001

(51) Int. Cl.[7] ..... H05H 9/00; H05H 13/10

(52) U.S. Cl. ..... 315/505; 315/507; 315/5.14; 250/396 R; 313/361.1

(58) Field of Search ..... 315/505, 507, 315/500, 5.14; 250/396 R; 313/361.1

(56) References Cited

U.S. PATENT DOCUMENTS 5,339,336 A * 8/1994 Sudan ..... 376/107

5,811,943 A * 9/1998 Mishin et al. ..... 315/505

* cited by examiner

*Primary Examiner*—Nikita Wells

(57) ABSTRACT

A linear accelerator with improved efficiency is disclosed. The linear accelerator contains at least one lower beam energy recirculating linear accelerator which is focused along a constant focal length, and at least one higher beam energy recirculating linear accelerator which is focused along a constant focal length, and a full energy recirculating line which received the beam from the higher energy recirculating linear accelerator and reinjects it into the higher energy recirculating linear accelerator, thereby balancing the focusing profile to the beam energy. Better envelope control, focusing, and higher efficiency is observed in linacs according to the present invention.

10 Claims, 4 Drawing Sheets

LINAC FOCUSED BY GRADED GRADIENT

BACKGROUND OF THE INVENTION

1. Field of the Invention

The present invention relates to the field of linear accelerators utilizing focusing fields. More specifically, it relates to multi-pass and energy-recovering linear accelerators and improved focusing methods therefor.

2. Description of the Prior Art

Linear accelerators are generally well known in the prior art. Fundamentally, a linear accelerator works by utilizing radio-frequency (RF) energy to accelerate charged particles. The charged particles may be electrons, protons, ions, or any of various particles, which may be capable of holding a charge.

RF energy is applied to the charged particles by at least one and usually a series of drift tubes, which vary in length and in other dimension and characteristics according to such design variables as the speed or size of the particle, the charge on the particle, the RF energy applied (wavelength and intensity), and focusing effects. As the drift tubes increase in number, a pronounced spreading effect is observed in the particle beam if left uncorrected.

This spreading effect has been long known and is countered in numerous ways in the known prior art. The primary ways of counteracting the drift effect may be divided into two main categories—electrostatic and electromagnetic.

Most linear accelerators are designed to accept particles at a so-called design injection velocity and in preordained "bunches". Other design limitations include losses from beam mismatch, and excessive gaps between the drift tubes, which can cause particle dispersion.

One of the most troublesome problems to address in the array of design considerations is the matching of the various energies to tube length, RF, and gap to provide for the fewest losses and consequently the most efficient particle accelerator.

OBJECTS OF THE INVENTION

Thus, it is an object of the present invention to provide a multi-pass or energy recovering linac with a more closely matched energy profile through the accelerator.

It is another object of the present invention to provide a more efficient linac, which is capable of receiving a wide range of input energy-level particles.

These, and other objects, will become readily apparent to one of skill in the art having regard for this disclosure.

SUMMARY OF THE INVENTION

The present invention provides an improvement in the beam dynamic control, beam confinement, beam stability, and an increased allowable dynamic range of injected to final energy. This is accomplished by the inventive novel beam transport topology and focusing methodologies.

DETAILED DESCRIPTION

As this invention may be more easily explained by reference to the attached drawings, it should be noted that the figures are representative and exemplary of the invention only, and should not be construed as limiting the scope of the invention in any way.

For ease of reference, the Figures are generic to the multiple embodiments described hereinbelow. With each embodiment, the meaning of the reference letters in the figure changes according to the detailed description.

More traditional beam transport topology employed in single or split multipass/energy recovering linacs is shown by reference to FIG. 1 (Prior Art), as follows. In this conventional topology, the linac focussing utilizes magnetic lenses set to either a constant magnetic field ("constant gradient") or a constant focal length ("constant focal length focussing"). As will be demonstrated herein, for either case, there is a severe mismatch of beam energy to focusing strength at various points along the beam transport path. The beam is either (or, sometimes, both) overfocused or underfocused at various point along the transport path.

EXAMPLE 1A (Prior Art)

Single Linac with Constant Gradient Focusing

Figure 1:
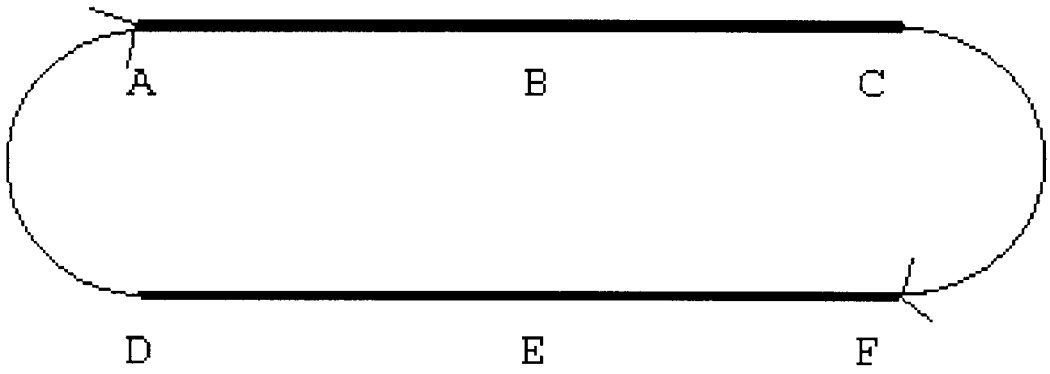
FIGURE 1 (PRIOR ART)
FIG. 1 is a diagrammatic representation of a linear accelerator, which may be multi stage or single stage.

In FIG. 1, the focusing profile for points A, B, and C is constant along the linac path, i.e. $f=f(E_{inject})$ at each of points A, B, and C. The energy profile, on the other hand, along points A and C is severely mismatched. For example, on the first pass, $E=E_{inject}$ for the first pass through the accelerator, and simultaneously $E=E_{final}$ for the last pass through the accelerator at Point A. Furthermore, $E=E_{final}$ after the first pass, and $E=E_{inject}$ for the last pass at Point C. Point B is an intermediate energy level equivalent to neither Point A nor Point C, normally. In essence, there is a consistent mismatch through the accelerator, merely varying in intensity along points A, B, and C. (In Example 1A, points D, E, and F are inactive, as it is a single linac).

EXAMPLE 1B (Prior Art)

Split Linac, Constant Gradient Focusing

In FIG. 1, for this example, points A, B, and C define one linac, and points D, E, and F define a second linac, a "split" linac structure. The focussing profile at point s A, B, C, D, E, and F s as follows (in tabular form for ease of reference hereinafter):

A $f=f(E_{inject})$

B $f=f(E_{inject})$

C $f=f(E_{inject})$

D $f=f(E_{inject})$

E $f=f(E_{inject})$

F $f=f(E_{inject})$

As one of skill in the art knows, a constant gradient is applied at each point of the pair of linacs to create the same field strength for purposes of focusing. However, the energy levels of the accelerated particles at each of the points is as follows:

$$AE = E_{inject}(\text{first pass}) \text{ and}$$

$$E = E_{final}(\text{last pass})$$

-continued $$CE = E_{mid}, \text{ where } E_{mid} = E_{inject} + (E_{final} - E_{inject})/2$$

$$FE = E_{mid}$$

$$DE = E_{final}(\text{first pass}) \text{ and}$$

$$E = E_{inject}(\text{last pass})$$

Thus, it may be clearly seen that for a constant gradient focusing scheme, in either a single or split linac, frequent mismatches between the particle beam energy and the focusing field strength are observed.

Turning now to the constant focal length focussing scenario, we can see that a similar mismatch is observed.

EXAMPLE 1C (Prior Art)

Single Linac, Constant Focal Length Focusing

For this example, the focusing profile along the beam path is set to a constant focal length. As for the constant gradient, despite the fact that the focussing strength alters along the beam path, it is also mismatched to the energy level of the particle beam.

For Example 1C (Prior Art), the focusing profile of FIG. 1 is as follows:

A $f=f(E_{inject})$

B $f=f(E_{mid})$, where $E_{mid}=E_{inject}+(E_{inject}-E_{final})/2$

C $f=f(E_{final})$

Points D, E, and F are inactive, as this example is a single linac.

The corresponding beam energy levels are as follows:

$$AE = E_{inject}(\text{1st pass}) \text{ and}$$

$$E = E_{final}(\text{last pass})$$

$$CE = E_{final}(\text{1st pass}) \text{ and}$$

$$E = E_{inject}(\text{last pass})$$

Thus, the beam mismatch problem exists in a single linac with constant focal length focusing. The following example illustrates the problem continues even when a split linac is utilized.

EXAMPLE 1D (Prior Art)

Split Linac, Constant Focal Length Focusing

For Example 1D (Prior Art), the focusing profile of FIG. 1 is as follows:

A $f=f(E_{inject})$

C $f=f(E_{mid})$ where $E_{mid}=E_{inject}+(E_{inject}-E_{final})/2$

F $f=f(E_{mid})$ where $E_{mid}=E_{inject}+(E_{inject}-E_{final})/2$

D $f=f(E_{final})$

The corresponding beam energy levels are as follows:

$$AE = E_{inject}(\text{1st pass}) \text{ and}$$

$$E = E_{final}(\text{last pass})$$

$$CE = E_{mid} \text{where } E_{mid} = E_{inject} + (E_{final} - E_{inject})/2$$

$$FE = E_{mid} \text{where } E_{mid} = E_{inject} + (E_{final} - E_{inject})/2$$

$$DE = E_{final}(\text{1st pass}) \text{ and}$$

$$E = E_{inject}(\text{last pass})$$

Figure 2:
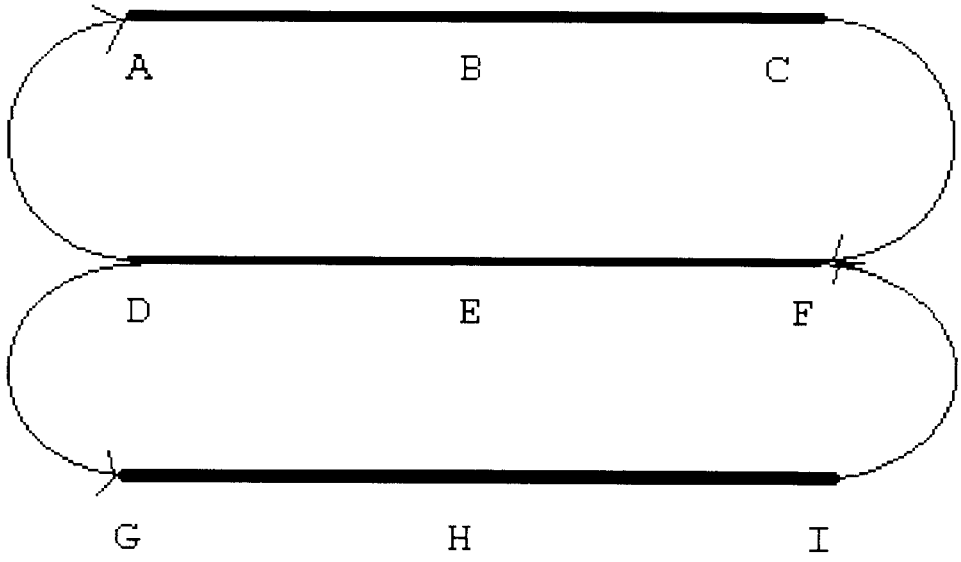
FIG. 2 is a diagrammatic representation of a multipath linear accelerator.

Turning now more precisely to the invention, the novel "graded gradient" beam focusing method of the present invention is clearly seen. The beam transport topology is shown in FIG. 2. It is noted that a split linac topology is illustrated in this example; however, one of skill in the art may easily apply this concept to multiple linac and/or multiple pass topology.

The focusing profile of the linac according to the present invention is as follows:

A $f=f(E_{inject})$

B $f=f(E_{1/4})$, where $E_{1/4}=E_{inject}+(E_{final}-E_{inject})/4$

C $f=f(E_{inject})$

F $f=f(E_{1/2})$, where $E_{1/2}=E_{inject}+(E_{final}-E_{inject})/2$

E $f=f(E_{3/4})$, where $E_{3/4}=E_{inject}+3(E_{final}-E_{inject})/4$

D $f=f(E_{1/2})$

G, H, and I are the full energy recirculation line and as such have no focusing profile.

The energy profile is as follows:

$$AE = E_{inject}(\text{first pass})$$

$$E = E_{1/2}(\text{last pass})$$

$$BE = E_{1/4}(\text{first pass})$$

$$E = E_{1/4}(\text{last pass})$$

$$CE = E_{1/2}(\text{first pass})$$

$$E = E_{inject}(\text{last pass})$$

$$FE = E_{1/2}(\text{first pass})$$

$$E = E_{final}(\text{last pass}$$

$$EE = E_{3/4}(\text{first pass})$$

$$E = E_{3/4}(\text{last pass})$$

$$DE = E_{final}(\text{first pass})$$

$$E = E_{1/2}(\text{last pass})$$

It is readily apparent that the energy and focusing levels are much better matched, or balanced, when the recirculating full energy line is fed back into the higher energy recirculating linear accelerator. Thus, the linear accelerators according to the present invention are far more efficient than conventional linear accelerators.

One of the features of the present invention involves recirculating and reinjecting the full energy beam into the high-energy linac, instead of reinjecting the full energy beam into the first (low energy) linac.

Reinjection of the full energy beam back into the high energy linac is accomplished by methods known to those of skill in the art having regard for this disclosure. Such methods include a beam spreader, recombiner, and transport line such as the one at the Continuous Electron Beam Accelerator Facility at the Thomas Jefferson National Accelerator Facility. See, for example, R. C. York and D. R. Douglas, "Optics of the CEBAF CW Superconducting Accelerator", *Proceedings of the* 1987 *IEEE Particle Accelerator Conference,* pp. 1292–1294, March 1987, Washington D.C., which is incorporated herein by reference as if fully set forth herein. See also D. R. Douglas, R. C. York, and J. Kewisch, "Optical Design of the CEBAF Beam Transport System", *Proceedings of the* 1989 *IEEE Particle Accelerator Conference,* pp. 557–559, March, 1989, Chicago Ill., which is also incorporated by reference as if fully set forth herein. In such systems, static magnetic fields are used to differentially bend beams of different energy, thereby separating them. Once separated, additional static magnetic fields can be applied to the separated beams, allowing an exact match of bending and focusing to the individual beam energies.

For an energy recovering linac according to the present invention, the linac focusing at constant focal length is intentionally matched to the accelerating beam energy profile through the linac for the first half of the linac, and then "reflected", or matched to the energy profile of the energy recovered beam in the back half of the linac.

This topology provides numerous advantages over the traditional focusing efforts known in the prior art. First, the match of focussing to energy is improved throughout the acceleration/energy recovery cycle, with a consequential reduction in beam envelope mismatch and beam loss. See, for example, FIGS. 3 and 4 which illustrate the difference between a constant gradient focusing and the graded gradient focusing of the present invention. Additionally, an improvement in beam confinement and stability, with concomitant overall machine performance is observed in a linac according to the present invention.

Figure 3:
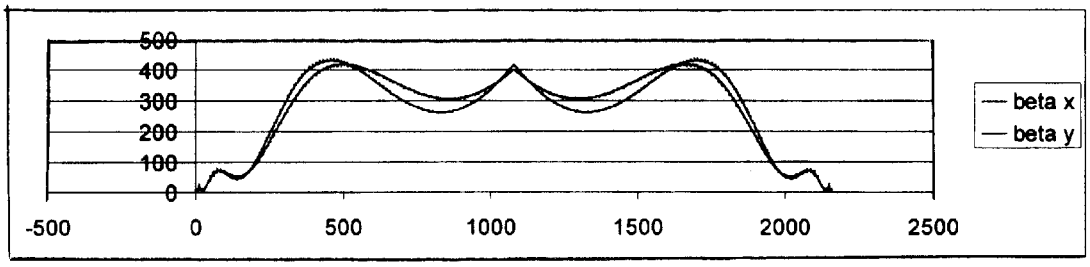
FIG. 3 is a graphical representation of a beam envelope of a recirculated energy recovering accelerator using graded gradient focusing.

With particular reference to FIG. 3, a numerically modeled beam envelope in a 10 MeV to 10 GeV recirculated energy recovering accelerator using constant gradient focusing, it can be seen that beam is widespread (beta x and beta y). With the graded gradient focusing of a 10 MeV to 10 GeV recirculated energy recovering accelerator using graded gradient focusing according to the present invention (as seen in the numerical model of FIG. 4), it may be seen that the beam is tightly focused.

As a result, the linac dynamic range for a linac constructed in accord with this disclosure; that is, the ratio of injected to final energy—and/or the linac length can be enlarged, reducing machine cost without adverse performance implications.

In the prior art, aberration effects and error sensitivities in an accelerator are known to scale linearly with beam envelopes (see, e.g. R. C. York and D. R. Douglas, "Perturbation Effects in the CEBAF Beam Transport System", *Proceedings of the* 1987 *IEEE Particle Accelerator Conference,* pp. 1295–1297, March, 1987, Washington, D.C., and D. R. Douglas,Chromatic changes in the CEBAF Beam Transport System", *Proceedings of the* 1991 *IEEE Particle Accelerator Conference,* pp. 449–451, May 1991, San Francisco, Calif., each of which are incorporated by reference as if fully set forth herein.

Figure 4:
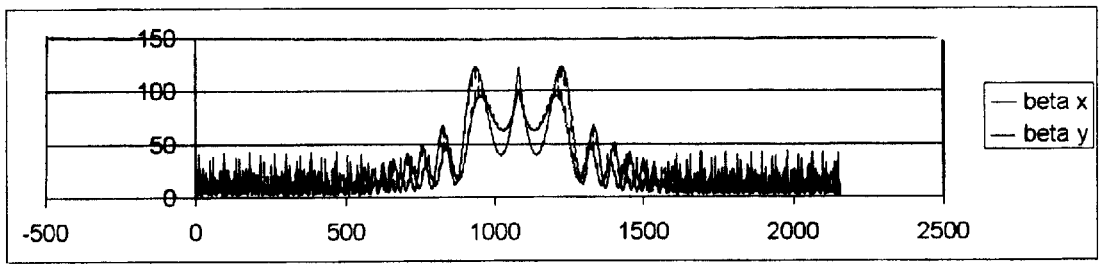
FIG. 4 is a graphical representation of a beam envelope in a recirculated energy recovering accelerator using graded gradient focusing.

It is readily seen from FIGS. 3 and 4 that as beam envelopes are reduced through the use of graded gradient focusing, said sensitivities are similarly reduced.

Furthermore, for applications such as linac-based synchrotron radiation facilities, the topology according to the present invention provides additional beam line length at full beam energy beyond that available in the configuration shown above, advantageous for the production of synchrotron radiation.

In an alternative embodiment, the two linacs need not have symmetrical energy gain. In particular, it will be observed that reduction of the first linac gain and increase of the second will improve the energy/focussing match in the first linac, where the energy is lowest, with only modest degradation of the match in the second, where the energy is higher and the performance inherently better.

In a preferred embodiment, the full energy recirculation line can, in construction realizations, line in the same tunnel as the split linacs, thereby reducing construction cost.

While the invention has been described by reference to the preferred embodiment disclosed herein, the invention is subject to considerable modification and may be tailored to fit the needs of many situations without departing from the scope or spirit of the claims, which are appended hereto.

What is claimed is:

1. An apparatus for improving the focusing and energy match of linear accelerators, comprising:

a plurality of recirculating linear accelerators forming a beam path, said plurality of recirculating linear accelerators including at least one recirculating linear accelerator at a lower beam energy and at least one recirculating linear accelerator at a higher beam energy, a full energy recirculation line connected to the higher beam energy recirculating linear accelerator, said full energy recirculation line receiving the full energy beam from the higher beam energy recirculating linear accelerator and reinjecting it into said higher beam energy recirculating linear accelerator, said lower beam energy recirculating linear accelerator being focused at a constant focal length, said higher beam energy recirculating linear accelerator being focused at a constant focal length, whereby the focusing energy and the beam energy are more closely matched along the plurality of linear accelerators.

2. An apparatus as claimed in claim 1, wherein the focusing energy in the recirculating linear accelerators is matched to an accelerating beam having a given energy in the first half of the recirculating linear accelerators, and the focusing energy is matched to a recovered beam having a given energy level in the second half of the recirculating linear accelerators.

3. An apparatus as claimed in claim 1, further comprising a source of synchrotron radiation.

4. An apparatus as claimed in claim 1, wherein the energy gain of the lower beam energy recirculating linear accelerator and the higher beam energy recirculating linear accelerator is asymmetrical.

5. An apparatus as claimed in claim 1, wherein the full energy recirculating beam is adjacent to either the higher or the lower beam energy recirculating linear accelerator.

6. An apparatus as claimed in claim 5, wherein the full energy recirculating beam is adjacent to the higher beam energy recirculating linear accelerator.

7. An apparatus as claimed in claim 1, wherein the full energy recirculating beam is in the same location as either the higher or the lower beam energy recirculating linear accelerator.

8. An apparatus as claimed in claim 7, wherein the full energy recirculating beam is in the same tunnel as either the higher or the lower beam energy recirculating linear accelerator.

9. An apparatus as claimed in claim 8, wherein the full energy recirculating beam is in the same tunnel as the higher beam energy recirculating linear accelerator.

10. An apparatus as claimed in claim 7, wherein the full energy recirculating beam is in the same location as the higher beam energy recirculating linear accelerator.

* * * * *